United States Patent [19]

Ericson et al.

[11] Patent Number: 4,688,987

[45] Date of Patent: Aug. 25, 1987

[54] SPLIT IMPELLER CENTRIFUGAL PUMP

[76] Inventors: Wallace W. Ericson, P.O. Box 442, 233 Shore Dr., Ozona, Fla. 33560; Steven Ericson, 4110 S. Rio Grande No. 3203, Orlando, Fla. 32809

[21] Appl. No.: 704,116

[22] Filed: Feb. 22, 1985

[51] Int. Cl.[4] ..... F04D 29/62; F01D 11/00

[52] U.S. Cl. ..... 415/97; 415/206; 415/219 C; 416/208; 416/244 B

[58] Field of Search ..... 415/93, 97, 98, 102, 415/206, 203, 219 C; 416/204 R, 204 A, 207, 208, 212 R, 212 A, 244 B, 244 R, 244 A; 403/282, 361

[56] References Cited

U.S. PATENT DOCUMENTS

| | | | |
|---|---|---|---|
| 997,587 | 7/1911 | Swenson | 416/236 R |
| 1,014,730 | 1/1912 | Way | 416/231 R |
| 1,345,952 | 7/1920 | Phelps | 416/207 |
| 2,067,839 | 1/1937 | Godfrey | 114/65 R |
| 2,684,635 | 7/1954 | Winkelman et al. | 415/206 X |
| 2,847,969 | 8/1958 | Woodruff | 116/273 |
| 2,925,783 | 2/1960 | Zimmerman et al. | 415/206 |
| 3,022,740 | 2/1962 | Wilfley et al. | 415/219 C |
| 3,082,026 | 3/1963 | Anderson | 403/361 X |
| 3,160,107 | 12/1964 | Ross | 415/219 C |
| 3,673,777 | 7/1972 | Weber | 403/282 X |
| 3,935,833 | 2/1976 | Onal | 415/203 X |
| 4,118,134 | 10/1978 | Mansel | 403/282 |
| 4,247,250 | 1/1981 | Lipe et al. | 415/219 C |

FOREIGN PATENT DOCUMENTS

| | | | |
|---|---|---|---|
| 422200 | 11/1925 | Fed. Rep. of Germany | 415/90 |

*Primary Examiner*—Robert E. Garrett
*Assistant Examiner*—Joseph M. Pitko
*Attorney, Agent, or Firm*—Dowell & Dowell

[57] ABSTRACT

A centrifugal pump having a split impeller which is directly mounted to an existing drive shaft and which is enclosed within a housing which is mounted in surrounding, spaced and non-contacting relationship with respect to the impeller and drive shaft so as to form annular fluid inlet openings between the housing and drive shaft through which fluids are directed by the impeller to an outlet from the housing.

6 Claims, 5 Drawing Figures

Fig. 3
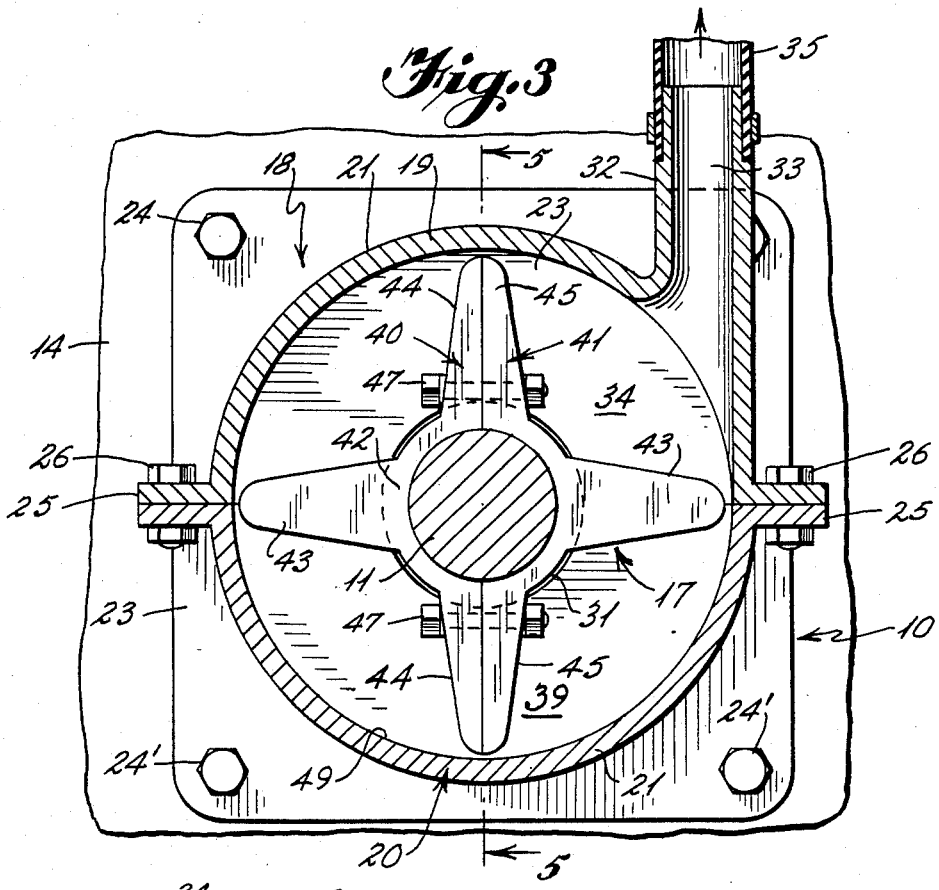
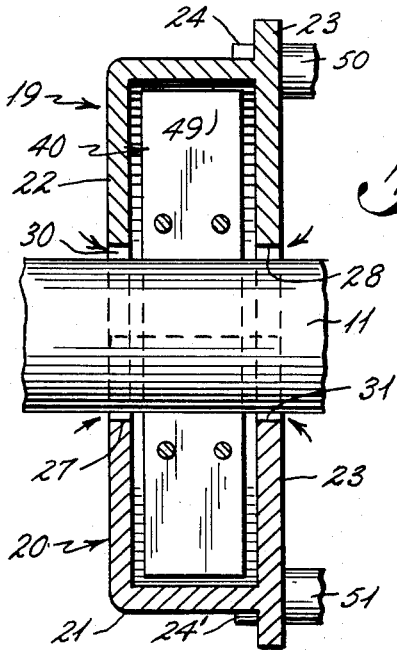
Fig. 4
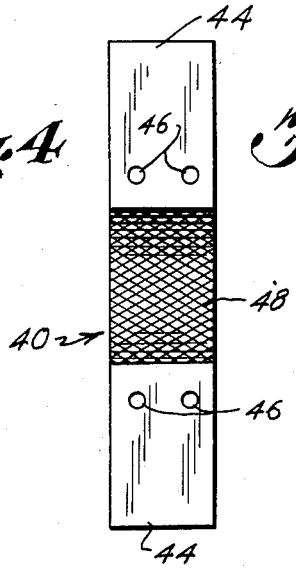
Fig. 5

SPLIT IMPELLER CENTRIFUGAL PUMP

BACKGROUND OF THE INVENTION

1. Field of the Invention

This invention is generally directed to centrifugal pumps having rotatably driven impellers mounted within a housing so as to create a fluid flow through such housing between the inlet and outlet therein and particularly to a centrifugal pump which includes an impeller which is mounted in tight engagement to an existing drive shaft so as to be rotatably disposed within a housing which is mounted so as to be in spaced but encompassing relationship to the impeller. Opposing fluid inlets are created between the sides of the housing and the drive shaft from which fluids are directed to a fluid outlet also formed in the housing.

2. Summary of the Invention

A centrifugal pump which is particularly adapted for use with an existing drive shaft and especially in the engine compartment or hull of a marine vessel in which a pair of split or sectional impellers are mounted for rotation to the existing drive shaft, such as a propeller drive shaft, and wherein the pump housing is also split and mounted so as to be in surrounding and spaced relationship to the impeller blades and drive shaft so that the impeller is freely rotatable therein in order to pump fumes or fluids in through annular intake openings between the drive shaft and pump housing and deliver the same through an outlet formed in the pump housing.

It is the primary object of this invention to provide a centrifugal pumping apparatus which can be selective mounted to the propeller drive shaft of an inboard type power boat or ship so as to enable fumes and fluid in the hull or engine compartment of the boat to be exhausted to atmosphere and thereby reduce both the hazards of explosions and flooding.

It is another object of the present invention to provide a centrifugal pump which is adapted to be selectively installed to existing drive shafts in environments wherein hazardous gases or fumes may be encountered and wherein the pump is structured so that the gas or fluid impeller is not journalled or directly mounted to the pump housing so that no heat is generated during the rotation of the impeller by friction between the impeller and the housing as is the case in pumps in which the impeller is directly carried by the pump housing.

It is yet a further object of the present invention to provide a centrifugal pump having a composite impeller mechanism which enables the impeller to be secured about an existing drive shaft so as to be directly driven with the drive shaft and wherein the direction of fluid flow is created by a separate composite housing which is fixed in spaced relationship around and spaced from the impeller and drive shaft.

It is also an object of the present invention to provide a centrifugal pump apparatus which is driven directly by an existing drive shaft to which the apparatus is mounted and to a pumping apparatus which does not require the lubrication and maintenance associated with conventional centrifugal pumps.

BRIEF DESCRIPTION OF THE DRAWINGS

FIG. 3 is an enlarged cross-sectional view showing the split impeller of the centrifugal pump of the present invention taken along lines 3—3 of FIG. 1.

FIG. 4 is a cross-sectional view taken along lines 4—4 of FIG. 2 showing the air and/or fluid flow into the opposed annular intake openings into the centrifugal pump of the present invention.

FIG. 5 is a cross-sectional view taken along lines 5—5 of FIG. 3 with the drive shaft removed showing the inner or drive shaft engaging surface of the impeller blades.

DESCRIPTION OF THE PREFERRED EMBODIMENT

Figure 1:
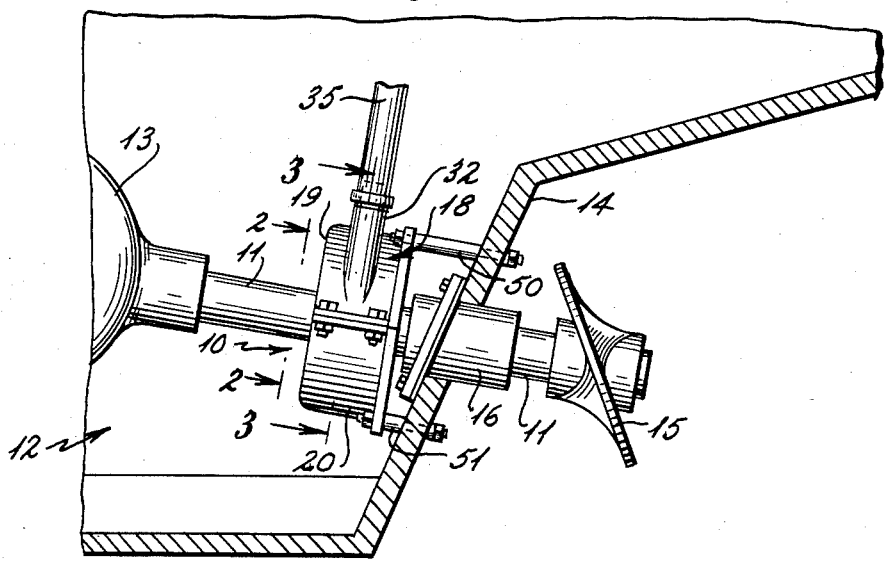
FIG. 1 is an illustrational view of the centrifugal pump of the present invention as it is shown mounted to the propeller drive shaft and transom of an inboard motorboat.
Figure 2:
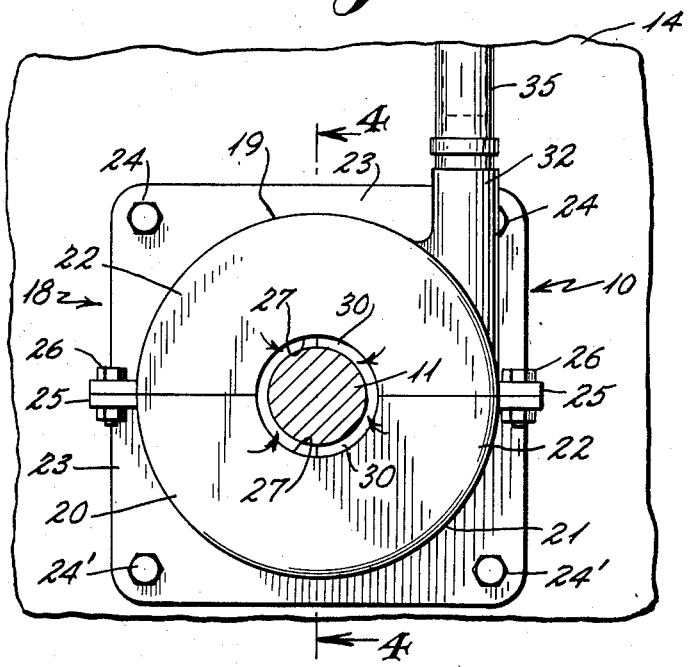
FIG. 2 is an enlarged front plan view of the centrifugal pump housing of the present invention taken along lines 2—2 of FIG. 1.

With continued reference to the drawings, the centrifugal pump 10 of the present invention is shown as it is mounted in relationship to a propeller drive shaft 11 within the hull 12 of an inboard motorboat. The drive shaft is shown in FIG. 1 as extending rearwardly from the engine 13, through the transom 14, to the propeller 15. A suitable bearing or stuffing box 16 is mounted through the transom so as to rotatably support the drive shaft therethrough. It should be noted that although the centrifugal pump 10 is being described for use with the propeller drive shaft of a conventional inboard motorboat, that the pump could be used in other environments as the structure of the pump is such that it is adapted for mounting to a variety of rotatable drive shafts. In addition, although only a single pump 10 is shown in the preferred embodiment, there may be occasions when two or more pumps would be used in the same environment such as a boat having twin screws driven by a pair parallel drive shafts.

The pump 10 is essentially constructed of two primary components which are an impeller 17 and a housing 18. The pump housing 18 is composed of upper and lower sections 19 and 20 which include a circular or semicircular sidewall 21, a front wall 22 and generally rectangular rear wall 23. Openings are provided in the upper corners of the rear wall 23 of the upper section 19 and through the lower corners of the rear wall 23 of the lower section 20 through which mounting bolts 24 and 24' may be selectively extended in a manner that will be described in greater detail hereinafter.

Each of the sidewalls 21 includes a pair of outwardly extending flanges 25 through which openings are provided so as to receive housing fastening bolts 26. When the upper and lower sections are joined in abutted relationship, the fastening bolts 26 will be tightened to retain the sections together.

To enable the housing to be installed about an existing drive shaft, a pair of aligned semicircular slots 27 and 28 are provided through the front and rear walls of each section 19 and 20. When the sections are assembled, the slots form a pair of spaced axial openings having a diameter greater than that of the drive shaft. As the arcuate walls 27 and 28 defining the drive shaft openings are spaced radially outwardly with respect to the drive shaft 11, a pair of opposing arcuately shaped fluid inlets 30 and 31 are formed through which gases, fumes and liquids may be drawn into the housing. The fluids drawn into the housing are directed outwardly therefrom through an exhaust nozzle 32 which is integrally formed extending outwardly from the sidewall of the upper pump housing section 19. With particular reference to FIG. 3, the exhaust nozzle forms a fluid passageway 33 which extends generally tangentially with respect to the generally tubular chamber 39 formed between the pump housing sections. In use, a hose or other fluid conduit 35 may be attached to the exhause nozzle 32 so as to extend therefrom to a location outside the hull so that any fumes or liquids will be discharged outwardly thereof.

Unlike prior art centrifugal pumps, the impeller 17 of the present invention is not connected or carried by the housing 18 but is constructed in two parts or halves 40 and 41 so as to be adapted to be directly mounted to an existing drive shaft such as the propeller drive shaft 11. Each half of the impeller includes a semicircular hub portion 42, a whole blade element 43 and split blade elements 44 and 45. A pair of openings 46 are provided through the split blades 44 and 45 adjacent the hub portion of the impeller so as to selectively receive pairs of mounting or clamping bolts 47. In order to insure that the impeller is tightly secured in nonslipping engagement to the drive shaft 11, the inner surfaces of the hub portions of the impeller are knurled or otherwise provided with locking ridges as shown at 48 in FIG. 5. The knurled portions of the hub will actually bite or lock the hub securely against the drive shaft as the bolts 47 are tightened.

In manufacturing the impeller, the diameter of the hub portions thereof should be generally equal to the diameter (or other configuration) of the drive shaft to which the impeller is to be mounted. In addition, the shape and number of blades may be changed so long as the two halves of the impeller are properly balanced so that the center of mass of the impeller will correspond to the axis of rotation of the drive shaft. In this manner any adverse stresses on the drive shaft will be prevented.

In order to create the desired suction and discharge at the inlet and discharge areas of the housing, the impeller blades are constructed to substantially extend outwardly to a point in close proximity with the inner surfaces 49 of the sidewalls 21. Additionally, the width of the blades is substantially equal to but slightly less than the distance between the front and rear walls 22 and 23. The design of the impeller and pump housing is such that upon rotation of the drive shaft 11, the impeller will simultaneously be rotated to thereby draw air, fumes, liquids or other fluids inwardly through the opposing inlets 30 and 31. Thereafter, the fluids are discharged under pressure through the passageway 33 in the outlet nozzle 32 and through the exhaust hose or similar conduit 35 to a point remote from the pump.

Although the housing 18 of the pump may be mounted in a number of ways in a fixed orientation about the drive shaft 11 and impeller 17, one example is shown in FIG. 1. In the mounting arrangement shown, the rear wall 23 of the housing is spaced forwardly of the stuffing box 16 by means of a pair of upper and lower cylindrical spacers 50 and 51 which extend between the housing and the inner wall of the transom 14. It is important to insure that the housing is spaced from the stuffing box and transom at least a small distance in order to permit unrestricted fluid flow inwardly of the housing through the inlet port 31. Further, the spacers 50 are shown as being of a greater length than the lower space 51 so that when the bolts 24 and 24' are tightly secured therethrough, the housing will be properly aligned with the axis of the drive shaft.

When the centrifugal pump of the present invention is utilized to remove hazardous fumes, gases, and liquids from the engine compartment or hull of a conventional inboard motorboat, the split impeller blades 40 and 41 are first position over the drive shaft 11. Thereafter, the impeller mounting bolts are tightened to lock the impeller in fixed position on the drive shaft. The two housing sections 19 and 20 are subsequently placed over the impeller and drive shaft and the assemblly bolts 26 tightened through the flanges 25 of the housing secticons. The mounting bolts 24 and 24' are then extended through the openings in the rear wall of the housing, the spacer elements 50 and 51 and the transom 14 and tightly secured to retain the pump housing in proper position. A discharge hose or conduit 35 is then attached to the discharge nozzle 32 of the housing and extended to atmosphere remote from the engine compartment or inside of the hull.

When the drive shaft 11 is driven by the engine, the impeller will rotate within the pump housing thereby drawing fluids including liquids and gases through the inlet ports 30 and 31 and thereafter discharging the fluids under pressure through the outlet nozzle 32. Therefore, the centrifugal pump of the present invention will automatically function to discharge any hazardous gaseous or fluid buildup whenever the propeller drive shaft is rotated. In addition, as there is no physical connection between the pump impeller and housing, there is no heat buildup or generated due to friction and thus the pump is safe for use in environments where ignitable or combustible fluids or gases are encountered. The components of the pump are preferrably constructed of materials which are resistant to rust and may be, either metallic or plastic depending upon the size and purpose for which the pump is to be used.

We claim:

1. A centrifugal pump apparatus for use with propeller drive shafts extending through the walled engine compartment of marine vessels wherein the atmosphere in the engine compartment is subject to the build up of hazardous gases or other fluids comprising a housing having front and rear walls and a peripheral side walls, a pair of aligned fluid inlet openings through said front and rear walls through which the drive shaft is selectively extended, mounting means for securing said housing to the walls of the engine compartment so as to be in fixed, spaced and non-contacting relationship around the drive shaft, said fluid inlet openings being larger than the cross sectional dimension of the drive shaft extending therethrough so as to create a pair of fluid passageways through said fluid inlet openings and entirely around the drive shaft into said housing, a fluid discharge outlet disposed through said housing and extending generally radially outwardly with respect to the drive shaft extending through said housing, an impeller means having at least first and second sections, means for mounting said first and second sections to the drive shaft within and in spaced relationship with said housing, whereby the impeller and housing cooperate to discharge hazardous fluids in response to the rotation of the drive shaft without generation of heat due to friction.

2. A centrifugal pump apparatus for use with rotatably driven drive shafts which are disposed within a walled enclosure for pumping fluids from the enclosure wherein the drive shaft is defined having a first cross sectional dimension comprising, a housing having front, rear and side wall portions, a pair of aligned fluid inlet openings in said front and rear walls of said housing, each of said fluid inlet openings being of a greater dimension than said first cross sectional dimension of the drive shaft, said housing having at least two sections which are divided along lines which intersect with said fluid inlet openings, means for selectively uniting said sections so as to enclose a portion of the length of the drive shaft therebetween and through each of said fluid inlet openings, mounting means connected to said housing and extending to a wall of the enclosure so as to retain said housing in encircling relationship to the drive shaft so that the drive shaft extends through each of said fluid inlet openings in spaced non-contacting relationship to said housing so that fluids entering said housing passes around said drive shaft and through said fluid inlet openings, a fluid outlet opening formed in said housing in spaced relationship from said fluid inlet openings, an impeller means mounted within said housing in non-contacting spaced relationship to said housing, said impeller means having at least first and second sections, each of said impeller means having a hub portion and outwardly extending blade means, and fastening means for securing said first and second sections of said impeller means to the drive shaft so that the hub portions thereof are in engagement with the drive shaft.

3. The centrifugal pump apparatus of claim 2 in which said fastening means for securing aid first and second sections of said impeller means to the drive shaft are positioned through said blade means.

4. The centrifugal pump apparatus of claim 2 in which said discharge opening is formed in said side wall of said housing and includes a nozzle means creating a channel which extends outwardly of said housing generally perpendicularly to said fluid openings and generally tangentially with respect to said side wall portions.

5. The centrifugal pump apparatus of claim 4 in which said housing defines a generally cylindrical chamber, said blade means of said impeller means substantially extending between said front and rear walls of said housing and outwardly into proximate relationship with said side wall portions thereof.

6. The centrifugal pump apparatus of claim 5 in which said rear walls of said housing include portions extending outwardly beyond said side walls, said means for mounting said housing in fixed relationship related to said impeller and drive shaft including spacer means extending from said outwardly extending portions of said rear walls so as to space said housing from adjacent walls of the enclosure.

* * * * *